US008313398B2

(12) United States Patent
Baker

(10) Patent No.: US 8,313,398 B2
(45) Date of Patent: Nov. 20, 2012

(54) HELICAL BROADHEAD

(76) Inventor: Robert Baker, Lerna, IL (US)

( * ) Notice: Subject to any disclaimer, the term of this patent is extended or adjusted under 35 U.S.C. 154(b) by 397 days.

(21) Appl. No.: 12/211,570

(22) Filed: Sep. 16, 2008

(65) Prior Publication Data

US 2010/0069182 A1 Mar. 18, 2010

(51) Int. Cl.
*F42B 6/08* (2006.01)

(52) U.S. Cl. ..... 473/583

(58) Field of Classification Search ..... 473/583, 473/584

See application file for complete search history.

(56) References Cited

U.S. PATENT DOCUMENTS 2,005,424 A * 6/1935 Kindle et al. ..... 473/583
4,534,568 A * 8/1985 Tone ..... 473/583
5,257,809 A * 11/1993 Carrizosa ..... 473/584
6,663,518 B1 * 12/2003 Kuhn ..... 473/583
6,887,172 B2 * 5/2005 Arasmith ..... 473/583
6,966,856 B1 * 11/2005 Hajek ..... 473/583

* cited by examiner

*Primary Examiner* — John Ricci
(74) *Attorney, Agent, or Firm* — Wilson Daniel Swayze, Jr.

(57) ABSTRACT

A helical broadhead for an archery arrow may include a tapered ferrule having a tip end and an arrow end, and at least two helical blades which extend from the tip end to and towards the arrow end. The at least two helical blades may continuously helically curve from the tip end to the back side of the helical blades, and the helical blades may include a cutting edge. The broadhead may include a threaded shaft, and the helical blades may be a constant thickness. The helical blades may include a tapered cross-section, and the cutting edges may form a tip.

6 Claims, 5 Drawing Sheets

HELICAL BROADHEAD

FIELD OF THE INVENTION

The present invention relates to arrows and more particularly to an arrowhead or broadhead having a helical curve.

BACKGROUND OF THE INVENTION

The bow hunter's goal at all times is accurately place a shot in a killing zone of a big game animal with maximum penetration to establish excessive hemorrhaging and ultimately result in a quick kill and successful animal retrieval thereby avoiding excessive tracking efforts, prolonged pain and suffering to be experience by the animal.

To achieve the hunter's goal, the archery industry has provided faster shooting and more powerful bows with increased percentage of "let off" allowing the hunter to hold the drawn bow longer while aiming. However, with faster and more powerful bows comes problems associated with the accuracy of arrow placement. One aspect to assist in arrow accuracy and stabilization has been the use of offset arrow feather fletching which brings a spin to the arrow to stabilize the arrow during flight and to increase its accuracy.

Broadheads at the tip end of the arrow cut into the target animal to establish hemorrhaging as they pass through vital organs. These known conventional broadhead blades seriously impede the rotation of the arrow and may in fact cause the arrow to wobble and deflect offline.

U.S. Pat. No. 6,966,856 discloses a helical broadhead for an archery arrow including a ferrule having a longitudinal axis with a tip end and an arrow end. Aligned forward and rearward slots are located in the ferrule generally parallel to the axis. At least two helical blade assemblies, each with an elongate cutting edge, spiral about the axis from a forward blade tang mounted in one forward slot to a rear tang mounted in a nonaligned, rearward slot. A chiseled tip having a sloping surface aligned with a helical blade assemblies may be attached to the tip end of the broadhead.

U.S. Pat. No. 7,182,706 discloses a broadhead type arrowhead for coupling to the shaft of an arrow including a plurality of insertable, removable blades, an elongate body having a tip and a depending body, the tip being designed for penetrating an object at which the arrow is directed, the body having a slot defined therein corresponding to each of the plurality of blades, each slot extending through a portion of the body offset from a broadhead longitudinal axis and having two slot openings, each of the slot openings being common with an adjacent slot; and each of the plurality of blades being selectively insertable in a respective slot from either of the common slot openings to effect a left offset or a right offset as desired.

SUMMARY

A helical broadhead for an archery arrow may include a tapered ferrule having a tip end and an arrow end, and at least two helical blades which extend from the tip end to and towards the arrow end.

The at least two helical blades may continuously helically curve from the tip end to the back side of the helical blades, and the helical blades may include a cutting edge.

The broadhead may include a threaded shaft, and the helical blades may be a constant thickness.

The helical blades may include a tapered cross-section, and the cutting edges may form a tip.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

This invention relates to the alignment of the blades and cutting edge is one or broadhead being attached to an arrow shaft which may be used for archery activity. Traditional broadhead blades and cutting edges have been designed in a straight line from the rear of the blade to the front of the plate. This design impedes the rotation of the arrow shaft during flight and substantially stops the arrow shaft rotation upon impact at the target regardless of the fletching configuration on the rear of the arrow shaft.

A helical broadhead blade and cutting edge extends forward in a gradual spiral around the arrow shaft from the rear of the blade to the front of the blade, increasing arrow shaft rotation during flight and upon impact rotation should continue, enhancing penetration. This increased rotation during flight causes more arrow shaft stability which may increase accuracy, and the arrow may be less vulnerable to the cross wind effect. This is similar to a bullet being fired from a gun with a rifled barrel (the inside of the barrel may be grooved to increase bullet rotation in flight). Upon impact at the target, the helical broadhead may produce a similar effect of a drill bit entering the material to be drilled. In contrast, the straight blade design typically stops rotation at the point of entry.

The cutting edge extends continuously from the rear of the blade to the front of the blade in a gradual spiral which may reflect a radius between the front and rear.

The cutting edge offset from rear to front may be between 1/32 inches and 1/2 inches.

The blades may be of constant thickness or may be of a tapered cross-section with respect to top the bottom.

The broadhead may have two blades, may have three blades or may have four blades. Furthermore, the number of blades can be increased to any desired number.

The broadhead may be formed as a solid one-piece broadhead or may be a broadhead having inserted blades.

Figure 1:
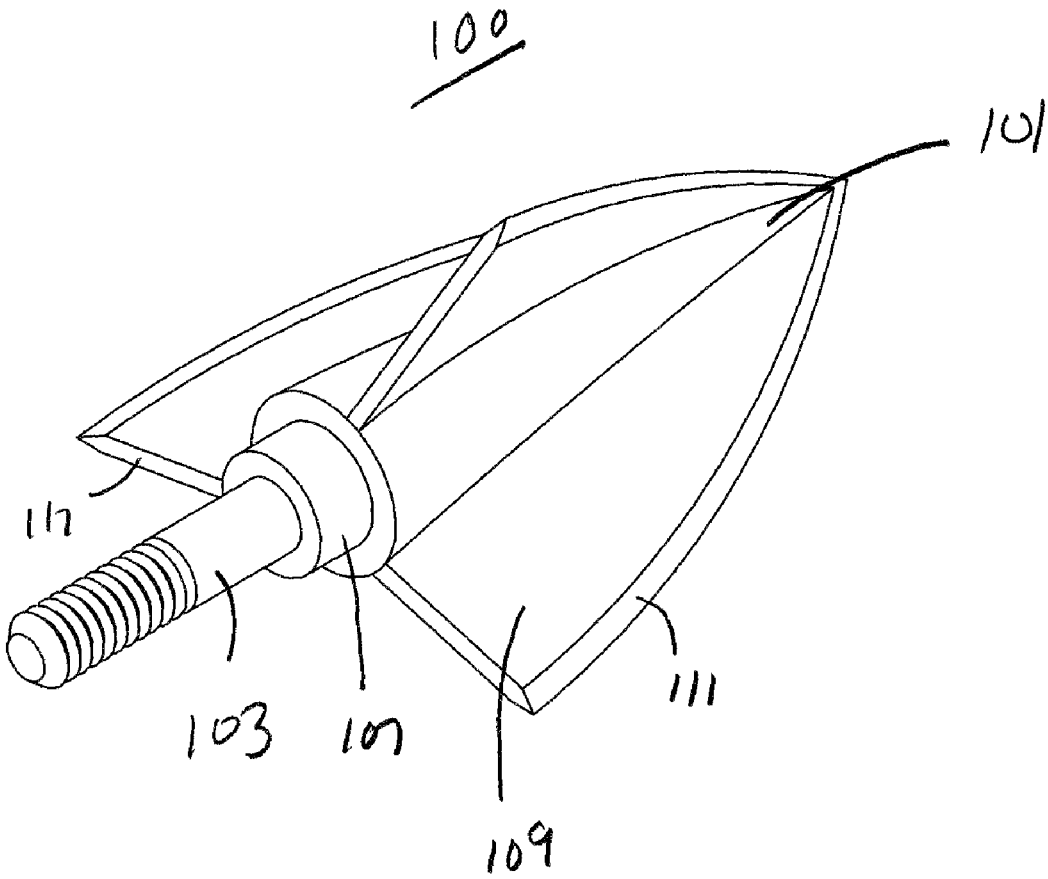
FIG. 1 illustrates a perspective view of the broadhead of the present invention.

FIG. 1 illustrates a perspective view of the broadhead 100 which may include a tapered ferrule 101 which may continuously taper from the back of the broadhead to the tip. The broadhead 100 may include a retention collar 107 which may be adjacent to the tapered ferrule 101 and may include an aperture to cooperate with a threaded shaft 103 which may have a threaded portion to form a threaded connection with the arrow shaft (not shown in FIG. 1). FIG. 1 illustrates a blade member 109 which may extend along the ferrule 101 and may have a cutting edge 111 which may extend from the tip of the ferrule 101 to the back surface 117 of the blade member 109. The back surface 117 may be substantially perpendicular to the ferrule 101. The blade member 109 may have a gradual helical curvature which may be continuous from the back surface 107 to the tip of the blade member 109.

Figure 2:
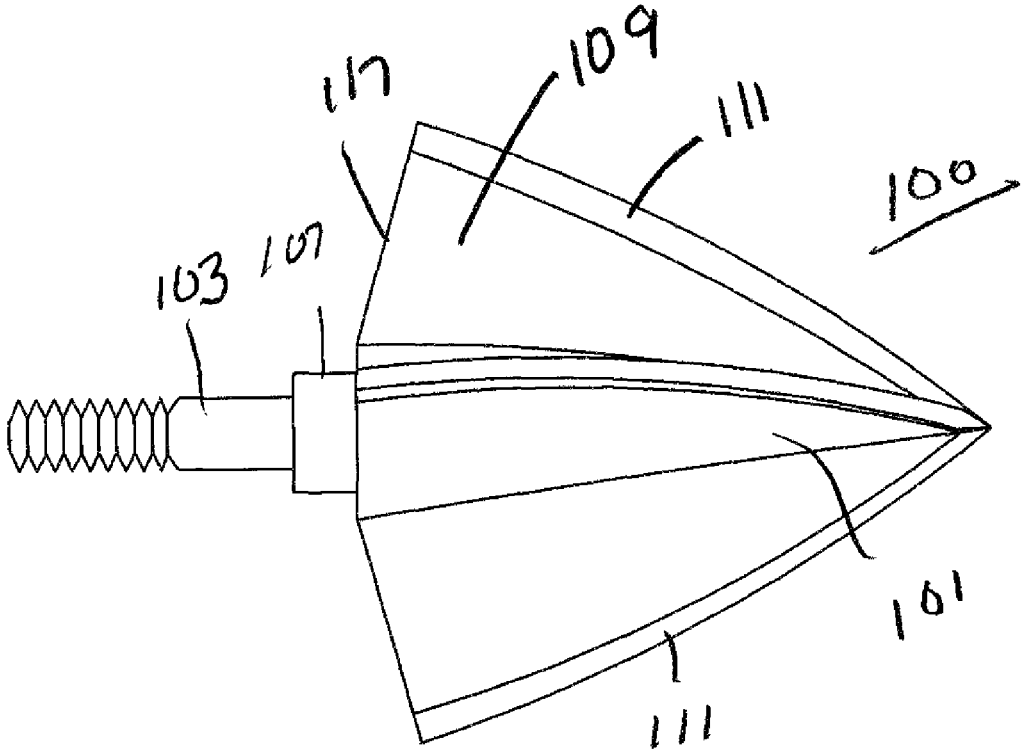
FIG. 2 illustrates a side view of the broadhead of the present invention.

FIG. 2 illustrates a side view of the broadhead 100 which may include a tapered ferrule 101 which may continuously taper from the back of the broadhead to the tip. The broadhead 100 may include a retention collar 107 which may be adjacent to the tapered ferrule 101 and may include an aperture to cooperate with a threaded shaft 103 which may have a threaded portion to form a threaded connection with the arrow shaft (not shown in FIG. 2). FIG. 2 illustrates a blade member 109 which may extend along the ferrule 101 and may have a cutting edge 111 which may extend from the tip of the ferrule 101 to the back surface 117 of the blade member 109. The back surface 117 may be angled to the ferrule 101. The blade member 109 may have a gradual helical curvature which may be continuous from the back surface 107 to the tip of the blade member 109.

Figure 3:
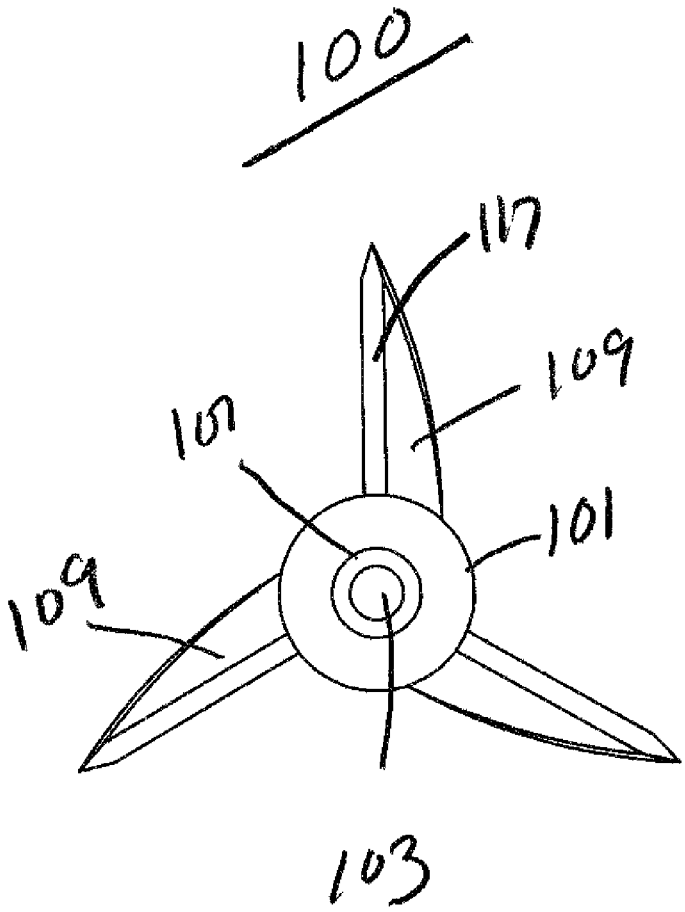
FIG. 3 illustrates a back view of the broadhead of the present invention.

FIG. 3 illustrates a back view of the broadhead 100 which may include a tapered ferrule 101 which may continuously taper from the back of the broadhead to the tip. The broadhead 100 may include a retention collar 107 which may be adjacent to the tapered ferrule 101 and may include an aperture to cooperate with a threaded shaft 103 which may have a threaded portion to form a threaded connection with the arrow shaft (not shown in FIG. 3). FIG. 3 illustrates a blade member 109 which may extend along the ferrule 101 and may have a cutting edge 111 which may extend from the tip of the ferrule 101 to the back surface 117 of the blade member 109. The back surface 117 may be angled to the ferrule 101. The blade member 109 may have a gradual helical curvature which may be continuous from the back surface 107 to the tip of the blade member 109.

Figure 4:
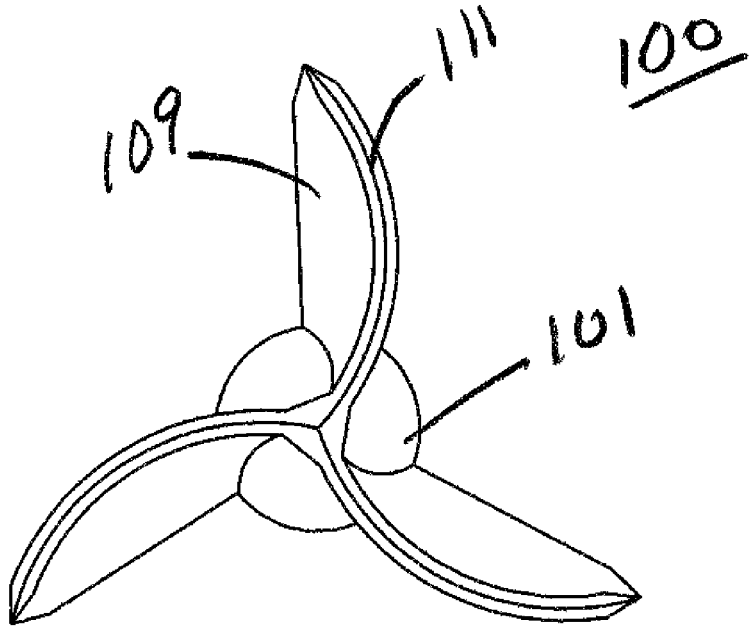
FIG. 4 illustrates a front view of the broadhead of the present invention.

FIG. 4 illustrates a front view of the broadhead 100 which may include a tapered ferrule 101 which may continuously taper from the back of the broadhead 100 to the tip. FIG. 4 illustrates a blade member 109 which may extend along the ferrule 101 and may have a cutting edge 111 which may extend from the tip of the ferrule 101 to the back surface 117 of the blade member 109. The back surface 117 may be angled to the ferrule 101. The blade member 109 may have a gradual helical curvature which may be continuous from the back surface 107 to the tip of the blade member 109.

Figure 5:
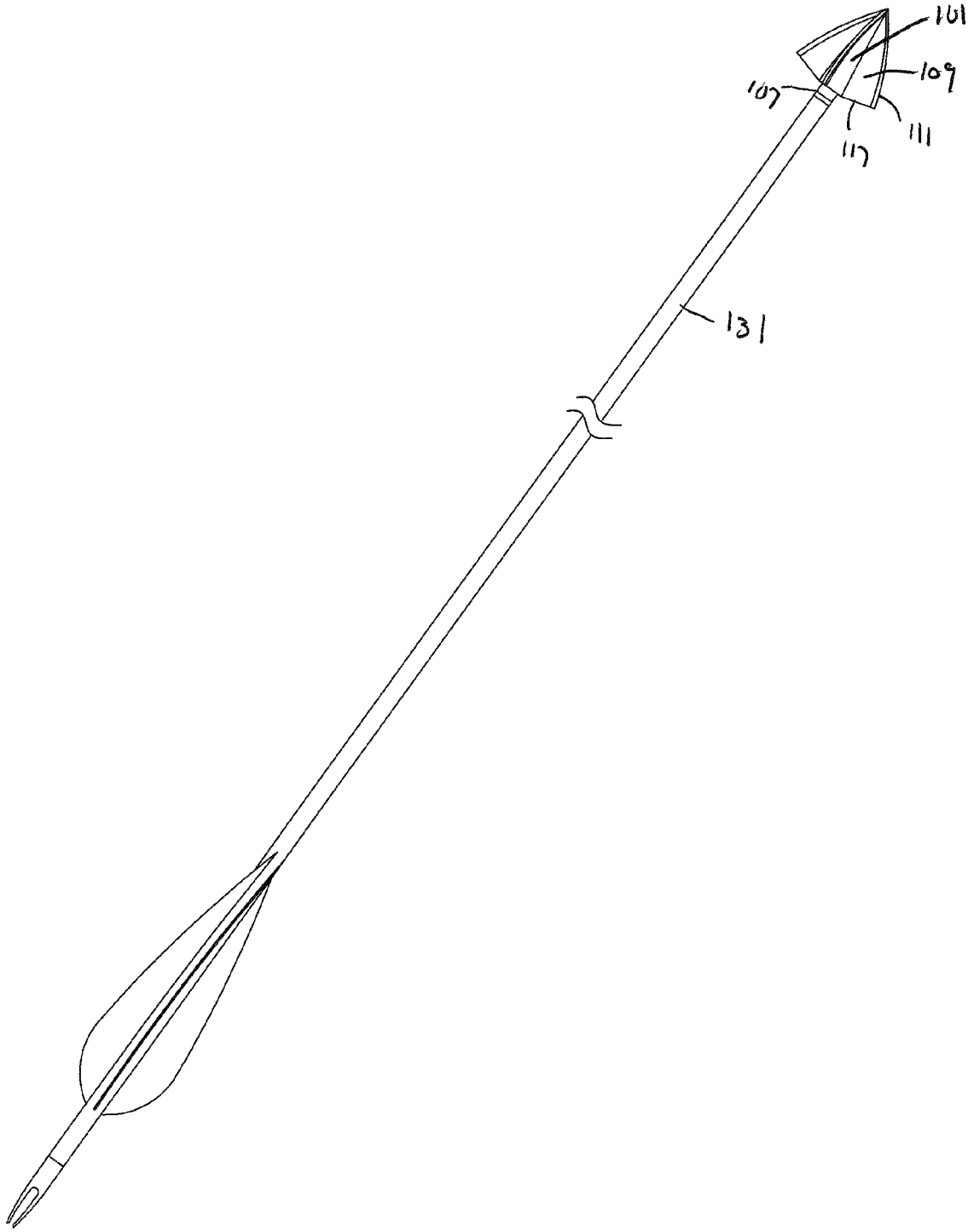
FIG. 5 illustrates a perspective view of the broadhead and arrow of the present invention.

FIG. 5 illustrates a perspective view of the broadhead 100 and arrow 131 in which the broadhead 100 may include a tapered ferrule 101 which may continuously taper from the back of the broadhead 100 to the tip. The broadhead 100 may include a retention collar 107 which may be adjacent to the tapered ferrule 101 and may include an aperture to cooperate with a threaded shaft 103 (see FIG. 3) which may have a threaded portion to form a threaded connection (not shown in FIG. 5) with the arrow shaft 131. FIG. 5 illustrates a blade member 109 which may extend along the ferrule 101 and may have a cutting edge 111 which may extend from the tip of the ferrule 101 to the back surface 117 of the blade member 109. The back surface 117 may be angled to the ferrule 101. The blade member 109 may have a gradual helical curvature which may be continuous from the back surface 107 to the tip of the blade member 109.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A helical broadhead for an archery arrow, comprising:

a tapered ferrule having a tip end and an arrow end;

at least two helical blades which extend from the tip end to and towards the arrow end;

wherein the at least two helical blades continuously helically curved from the tip end to the back side of the helical blades and continuously helically non reversing curved to rotate the helical broadhead clockwise and wherein the tapered ferrule includes a central axis and wherein the helical blades include a base and a cutting edge and wherein the base and the cutting edge of the helical blades does not follow the central axis of the tapered ferrule.

2. As in claim 1, wherein the helical blades includes a cutting edge.

3. A helical broadhead for an archery arrow as in claim 2, wherein the cutting edges form a tip.

4. A helical broadhead for an archery arrow as in claim 1, wherein the broadhead includes a threaded shaft.

5. A helical broadhead for an archery arrow as in claim 1, wherein the helical blades are a constant thickness.

6. A helical broadhead for an archery arrow as in claim 1, wherein the helical blades include a tapered cross-section.

* * * * *